United States Patent [19]

Smith

[11] Patent Number: 4,649,964

[45] Date of Patent: Mar. 17, 1987

[54] PAPER MAKING FABRIC HAVING A REDUCED PERMEABILITY PROFILE

[75] Inventor: Richard W. Smith, Greenville, S.C.

[73] Assignee: Wangner Systems Corp., Greenville, S.C.

[21] Appl. No.: 653,560

[22] Filed: Sep. 24, 1984

[51] Int. Cl.[4] ..... D03D 23/00

[52] U.S. Cl. ..... 139/383 A; 34/116; 162/348

[58] Field of Search ..... 139/383 A, 425 A, 408, 139/411, 412; 102/DIG. 1, 348, 358; 34/116, 123; 162/348

[56] References Cited

U.S. PATENT DOCUMENTS

| | | | |
|---|---|---|---|
| 1,879,243 | 9/1932 | Hoffacker | 139/383 A |
| 2,797,713 | 7/1957 | Hoffacker | 139/383 A |
| 2,903,021 | 9/1959 | Holden | 139/383 A |
| 3,867,766 | 2/1975 | Wagner | 139/383 A |
| 4,426,795 | 1/1984 | Rudt | 139/383 A |
| 4,460,023 | 7/1984 | Mullaney | 139/412 |

*Primary Examiner*—Henry S. Jaudon
*Attorney, Agent, or Firm*—Cort Flint

[57] ABSTRACT

A woven paper making fabric (A) is disclosed having a profiled permeability characteristic which varies across the width of the fabric yet the tensions are relatively uniform across the width of the fabric. The fabric includes a plurality of warp yarns (20, 22, 24, 26) extending in a machine direction and a plurality of weft yarns (28, 30, 32) extending in a cross-machine direction in the fabric woven with the warp yarns. The weft yarns and warp yarns are woven to provide at least two layers (60, 62, 64) in the fabric. A number of unwoven fabric closure elements (B) are bound between the weft yarns of two of the fabric layers (60, 62) extending in the machine direction adjacent the lateral edges (42, 44) of the fabric (A). The closure elements (B) extend through the fabric parallel to the edges in a generally straight configuration between the two fabric layers (60, 62) in a generally tensionless state so as not to effect the tension of the weave of the fabric. A uniform weave tension exists across the width of said fabric. The closure elements block the flow of air through the fabric to reduce the permeability of the fabric at the lateral edges (46, 48) and provide the desired permeability profile.

14 Claims, 6 Drawing Figures

PAPER MAKING FABRIC HAVING A REDUCED PERMEABILITY PROFILE

BACKGROUND OF THE INVENTION

In the process of making paper which begins with an aqueous suspension of fibers deposited onto a traveling paper-forming fabric, the formation of the paper occurs in different steps during which the paper being formed is at least partially supported on a traveling belt having a fabric designed to accomplish processing of the paper at a particular step in the process. In the dryer section of the paper making machine, heated cylinders are arranged so that an endless traveling dryer fabric holds a paper web in contact with the drying cyliners for drying of the paper web.

Woven dryer fabrics have been heretofore provided which consist of synthetic yarns woven together in a relatively open weave which is fluid permeable. The weave pattern of the fabric is carried out to satisfy the permeability and other requirements which are determined by the grade of paper being made and the operating conditions. The heated cylinders of the dryer section of the paper making machine are typically heated by introducing steam into the interior of the cylinders, by infrared radiation, or by other suitable means. It has been found that the temperature of the heated cylinder varies from one end to the other by a considerable amount. This creates the possibility that some portions of the paper web will be subjected to greater drying action than other portions of the paper web which creates a non-uniform moisture profile in the paper web across the width of the web. It has also been found that water vapor accumulates in the central portion of the paper web due to the fact that the lateral edges of the paper web lie closer to the surrounding atmosphere and may be more readily ventilated.

To eliminate a higher moisture content near the center of the paper web than at its edges, dryer fabric having less permeability at the edges of the fabric has been provided. In this manner, it has been attempted to provide a uniform moisture profile of the paper web across its width from one end of the heating cylinder to the other. In U.S. Pat. No. 3,867,766, it has been proposed to vary the number of warp elements at the lateral edges of the dryer fabric to produce a reduced permeability at the edges. Alternate methods of reducing the permeability of the lateral edges of the dryer fabric have included varying the diameter or the density of the warp yarn elements at the lateral edges of the fabric. In U.S. Pat. No. 4,460,023 it is proposed to insert an additional pick of the weft yarn across the width of the fabric at the lateral edges of the fabric to reduce the permeability at the edges. The remainder of the pick across the width of the fabric is severed so that the pick of the weft yarn only exists at the lateral edges.

Another method of reducing the permeability of paper making fabric at the edges of the fabric is disclosed in U.S. Pat. No. 4,426,795 wherein treatment of the edges is carried out to effect increased drying efficiency at the center of the belt to compensate for decreased drying efficiency at the center of the paper web being dried.

In the above proposals where reduction of permeability at the lateral edges of the fabric is achieved by weaving, the result has been that the tension of the fabric across its width is made to vary. This is because the additional warp elements or warp elements of different characteristics are under different tensions in the weave. The resulting woven fabric has a variable tension profile across its width wherein the flexibility of the fabric is decreased at the lateral edges. In repeated traveling about the belt rollers on the paper-making machine, the non-uniform tensions and flexibilities of the fabric can cause distortion of the fabric. The center of the fabric tends to become bowed and the open spaces of the fabric in the medial portion of the fabric begin to close in whereby the permeability profile of the fabric is lost. Moreover, the less flexible lateral edges of the fabric are susceptible to flex fatigue during repeated travel of the fabric in an endless configuration about the belt rollers.

Accordingly, an important object of the present invention is to provide a paper-making fabric for a paper making machine wherein the permeability profile of the fabric is varied across its width, yet uniform tension is provided across the width of the fabric.

Still another important object of the present machine is to provide a dryer fabric for a dryer section of a paper-making machine having reduced permeability at its lateral edges and uniform tension across its width.

Still another important object of the present invention is to provide a woven dryer fabric for a dryer section of a paper making machine wherein additional closure elements are provided in the warp direction of the fabric which are not woven in the fabric so that the presence of the closure elements does not effect the tension of the woven elements in the fabric.

Still another important object of the present invention is to provide a method of weaving a dryer fabric for a dryer section of a paper making machine wherein a desired permeability profile may be provided across the width of the fabric, yet at the same time, the fabric may be provided with a uniform tension profile across the width of the fabric in a woven structure.

SUMMARY OF THE INVENTION

The above objectives are accomplished according to the present invention by providing a woven dryer fabric which includes a plurality of warp elements and a number of weft elements which are woven together in a multi-ply dryer fabric. The dryer fabric, preferably, includes two outer layers and an intermediate layer. Adjacent the lateral edges of the dryer fabric, closure elements are included in the fabric which extend in the warp direction between an outer layer and the intermediate layer of the fabric. The closure elements are bound between the weft element of the outer and intermediate layers of the fabric in an unwoven generally tension-free state. The closure elements extend straight through the fabric parallel to the edges and reduce the air flow through open spaces in the fabric at the lateral edges of the fabric. In this manner, the presence of the closure elements does not effect the weave construction of the fabric insofar as the tension of the woven elements is concerned. The resulting fabric has the desired permeability profile across its width without effecting the tension of the weave which is generally uniform across the width of the fabric.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, a paper web W is illustrated (FIG. 1) passing through a dryer section of a paper-making machine which includes a plurality of upper heating cylinders 10 and lower heated cylinders 12 about which the paper web W travels in a serpentine manner while passing through the dryer section. The paper web W is maintained in contact against the upper heated cylinders by an endless, continuous traveling fabric belt A which travels about rollers 16. In operation, a second dryer fabric belt A is typically utilized in a lower position to maintain the paper web W in contact with the lower heated cylinders 12.

Figure 4:
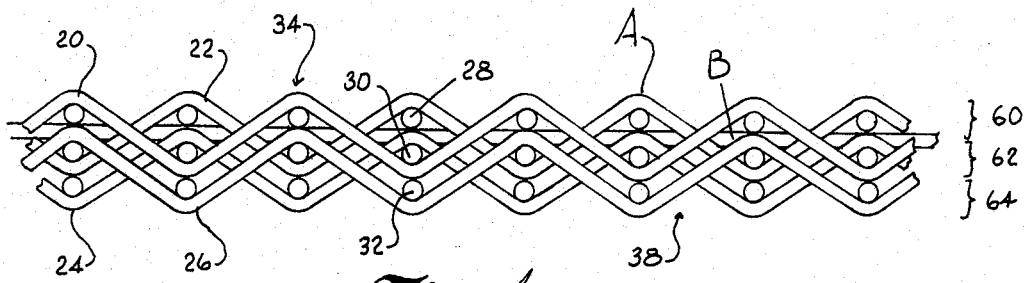
FIG. 4 is a sectional view taken along line 4—4 of FIG. 3.
Figure 5:
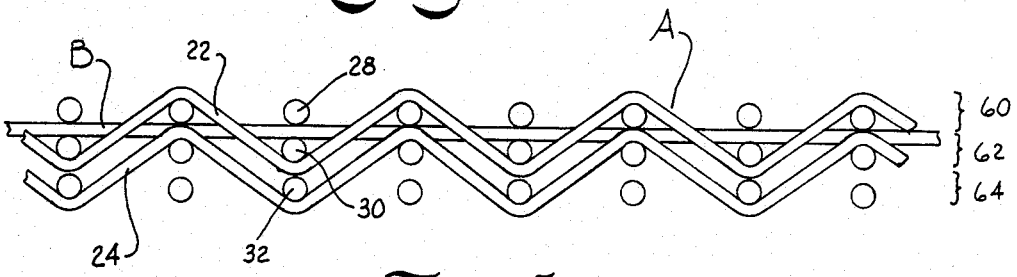
FIG. 5 is a sectional view taken along line 5—5 of FIG. 3.
Figure 6:
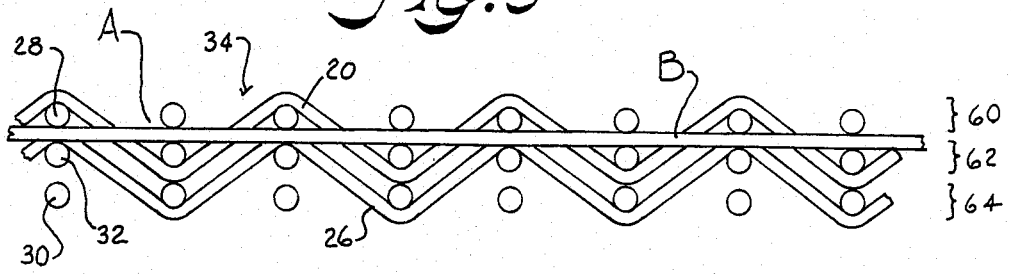
FIG. 6 is a sectional view taken along line 6—6 of FIG. 3.

The paper-making fabric A, illustrated for use in a dryer section of a paper-making machine includes first woven elements in the form of first, second, third and fourth warp yarns 20, 22, 24, and 26. The warp yarn elements are repeatedly woven with second woven elements in the form of weft yarns 28, 30, and 32 in a triple layer fabric configuration, as can best be seen in FIG. 4. The warp yarns extend in a first or machine direction and the weft yarns extend in a second or cross-machine direction since the fabric is woven flat. The yarns would extend in the reverse of the above direction if the fabric is woven in an endless configuration. While the invention is illustrated in the form of a three-ply fabric, it is to be understood that the invention can be woven in other multi-ply configurations of two or more.

Figure 3:
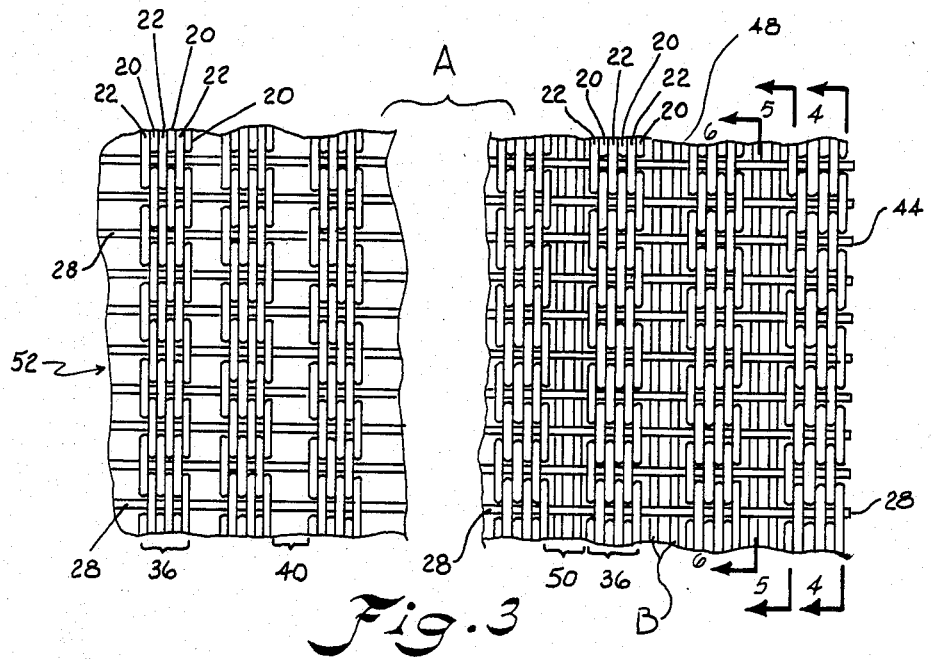
FIG. 3 is a top plan view cut in part of a paper-making fabric constructed according to the present invention.

As can best be seen in FIGS. 3 through 6, the warp yarns 20 and 22 are woven with the weft yarns 28 and 30 and appear on the papér contact side 34 of the fabric A as can best been seen in the top plan view of FIG. 3. The warp yarns 20 and 22 repeat themselves three times across the width of a woven lane 36 extending in the machine direction in the fabric. On the opposite side of the fabric, the warp yarns 24 and 26 are likewise woven in a lane by being interwoven with the weft elements 30 and 32.

The woven lanes 36 are spaced across the fabric. An open lane 40 is formed between the adjacent woven lanes 36. The only weaving elements appearing in the open lane 40 are the weft elements 28, 30 and 32 extending between the woven sections across the width of the fabric. The fabric A is open in the area of the open lanes for the flow of fluid through the fabric.

At the lateral edges 42 and 44 of the fabric, the open lanes 40 between adjacent ones of the woven lanes 36 are provided with non-woven closure elements B which extend in the warp or machine direction in the fabric A to form covered lanes 50 for the purposes of reducing the permeability at the edges of the fabric. The closure elements B are unwoven in the sense that they are not interlaced with the weft yarns as are the warp yarns which undulate through the fabric as they pass over and under the weft yarns. The closure elements are bound between the weft yarns of two adjacent layers and extend straight in the fabric parallel to the edges and the undulating warp yarns. By being unwoven, generally little if any tension is placed on the warp closure elements during weaving and the tension of the final woven fabric is not significantly affected by the closure elements in the fabric.

Figure 1:
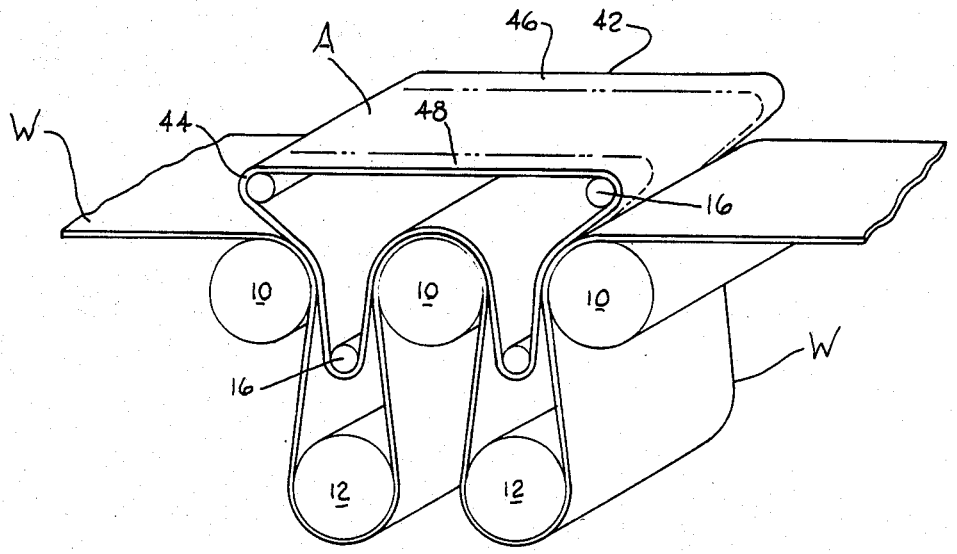
FIG. 1 is a perspective view illustrating a paper web passing through a dryer section of a paper-making machine being held in contact with the heated cylinders by a paper making fabric constructed in accordance with the present invention.
Figure 2:
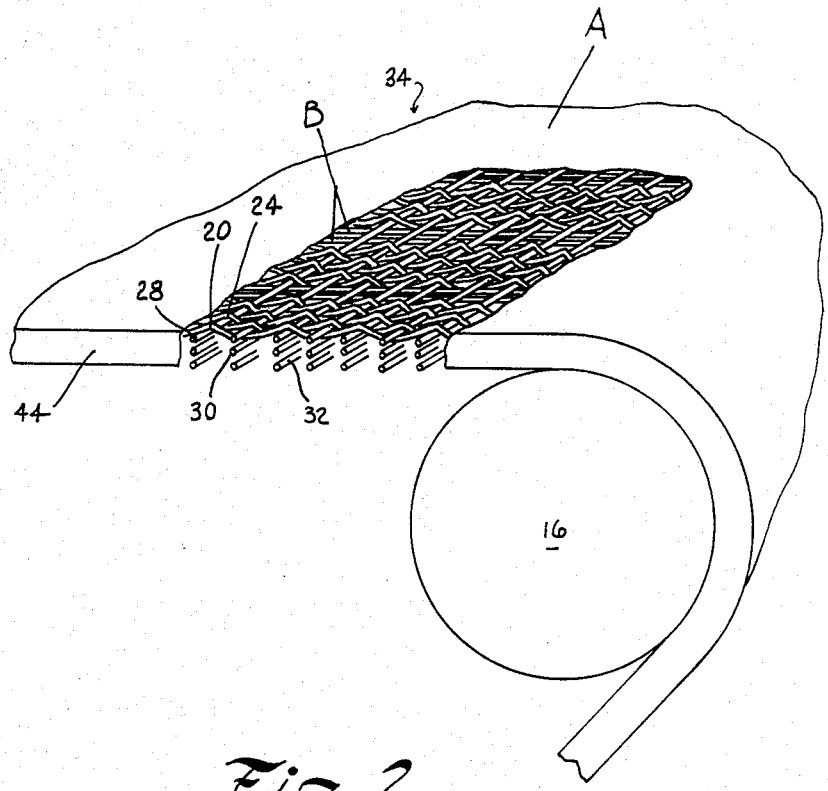
FIG. 2 is an enlarged view of a paper-making fabric constructed in accordance with the present invention with the parts of the fabric shown in detail.

As can best be seen in FIG. 1, there is a narrow band width 46 and 48 at the lateral edges in which the woven lanes 36 and the covered lanes 50, defined by the placement of the closure elements B in the open lanes 40, alternate with one another. The width of the reduced permeability bands 46 and 48 typically occupies up to about twenty-five percent of the total width of the fabric A. The middle of the fabric, between the reduced permeability bands 46 and 48, typically is open, as shown generally at 52 in FIG. 3. This open median portion of the fabric includes the woven lanes 36 and open lanes 40 alternating with one another. Of course, other permeability profiles may be produced so that the reduced permeability bands 46 and 48 do not immediately go to the open fabric design as shown at 50. In this case, a tapering off of the reduced permeability profile may be had by including covered lanes 50, for example, at every third open lane, from the reduced permeability bands inwardly toward the center of the fabric. In practice, a typical dryer fabric may be anywhere from 10 to 30 feet in width so that the profiling of the permeability of the fabric across its width may be had in any desirable manner according to the width of the fabric and the application being made of the fabric.

The fabric A is illustrated in the form of three layers. There is a first outer layer 60 which is on the paper contacting side 34 of the fabric. The layer 60 includes the weft elements 28 woven with the warp elements 20 and 22. There is an intermediate layer 62 which includes the weft elements 30 woven with the warp elements 20, 22, 24, and 26. There is a second outer layer 64 which includes the weft elements 32 woven with the warp elements 24 and 26. As can best be seen in FIGS. 4 through 6, the non-woven closure elements B lie between the weft elements 28 and 30 in the first outer layer 60 and the intermediate layer 62. The closure elements are preferably located on the paper contacting side 34 of the fabric.

In practice, the weft yarns 28, 30, and 32 may be any suitable yarn such as a synthetic reinforced fiberglass yarn. The woven warp elements 20 through 26 may be any suitable yarns such as an aramid. The closure elements B may be any suitable spun yarn such as an acrylic yarn. The number and characteristics of the closure elements B may be provided as desired to achieve the permeability profile reduction needed in the bands 46 and 48 of the fabric. The closure elements B are held in the harnesses during weaving in a generally uniform low tension so that when the fabric A is woven by interweaving the warp and yarn elements, the presence of the closure element B presents no additional tension in the woven fabric. In this manner, only the tension of the warp elements 20, 22, 24 and 26 as woven across the width of the fabric exists in the fabric. The closure elements B are embodied in the fabric in a manner that they block air, but generally do not bear loads as do the warp elements 20, 22, 24, and 26. Thus, the presence of the closure elements B do not effect the tension of the woven fabric nor effect the flexibility of the fabric at its edges.

According to the method of the present invention, a uniform tension and flexibility profile exists across the width of a fabric having a reduced permeability at its edges by placing a non-woven warp closure elements B between the weft elements 28 and 30 of two adjacent layers 60 and 62 of the fabric. The remaining warp elements 20 through 26 of layer 60 and 62 are interwoven with the weft elements. The closure element is thus captured within the weave without placing any additional tension on the woven fabric. By placing the closure elements in the open lanes 40 of the fabric during weaving, the lateral edges of the fabric may be effectively reduced in their permeability so that a desired permeability profile may be had across the width of the fabric which will facilitate uniform drying of the paper web across its width. The central portion of the paper web where more moisture exists will receive more drying air.

During weaving, as the woven warp yarn elements are crimped in an undulating configuration, the closure elements are inserted in the weave in a non-crimped state and, also, in a non-stretched condition so that no tension is placed on the fabric by the presence of the closure elements in the fabric. A reduction in permeability is had at the edges without a reduction in flexibility as occurs when prior additional woven elements have been included at the edges. Uniform flexibility and tension is thus had across the width of the fabric.

While a preferred embodiment of the invention has been described using specific terms, such description is for illustrative purposes only, and it is to be understood that changes and variations may be made without departing from the spirit or scope of the following claims.

What is claimed is:

1. A woven multilayer paper-making fabric having a profiled permeability for use in the dryer section of a paper-making machine comprising a number of first yarns extending in a first direction and arranged spaced across the width of the fabric, a number of second yarns extending in a second direction transverse to said first direction, said first yarns being woven with said second yarns to provide a fabric of at least two layers and spaced open lanes formed along its length between adjacent ones of said first yarns, said profiled permeability of said fabric including a medial portion having a first air permeability and edge portions located along opposing sides of said medial portion having a air permeability which is less than the first air permeability of said medial portion, elongated closure elements located in said open lanes in said opposing sides of said fabric alongside said medial portion, said closure elements extending parallel to said lanes in a straight unwoven manner so that closure elements increase the density of said sides and thereby reduce the air permeability thereof, and said closure elements being bound in said fabric in a generally nonundulating, tension-free state.

2. The fabric of claim 1 wherein said first woven yarns are woven over and under said second yarns in an undulating manner, said closure yarns being generally parallel to said first yarns and passing under all of the second yarns of a first layer and over all of the second yarns of a second layer to be bound therebetween, said closure elements passing straight through said fabric in an unwoven configuration.

3. The fabric of claim 1 which includes a number of said first and second yarns, woven together in a first outer layer; an intermediate fabric layer which includes a number of said first and second yarns woven together; and a second outer layer which includes a number of said first and second yarns woven together.

4. The fabric of claim 3 wherein said closure elements extend through said fabric between said first outer layer and said intermediate layer, said first outer layer being the side of said fabric which contacts said paper while being dried in the dryer section of said paper-making machine.

5. The fabric of claim 1 wherein said fabric includes a number of woven lanes extending in said first direction which include said first and second yarns woven together, a number of open lanes parallel to said woven lanes, said open lanes including only said second yarns extending cross-wise to said woven lanes, and a number of covered lanes parallel to said woven lanes which include said closure elements occupying said open lanes bound between said second yarns.

6. The fabric of claim 4 wherein said fabric includes at its lateral edges a number of woven lanes and covered lanes alternating with one another.

7. The fabric of claim 5 wherein said fabric includes a number of alternating open and woven lanes in a medial portion of said fabric.

8. The fabric of claim 1 wherein said first yarns are warp yarns and said first direction is the machine direction.

9. The fabric of claim 8 wherein said second yarns are weft yarns extending in a cross-machine direction.

10. The fabric of claim 8 wherein said weft yarns extending in a generally straight configuration.

11. A method of weaving a multilayer paper-making fabric for supporting paper on a paper-making machine comprising providing a number of first yarns extending in the machine direction, providing a number of second yarns extending in a cross machine direction, weaving said first and second yarns together in a predetermined pattern such that at least two woven layers including a number of woven lanes and separated open lanes both extending in the machine direction are formed in said fabric, placing a number of non-woven closure elements in a tension-free state between the second yarns and parallel to and between said woven lanes adjacent both lateral edge portions of said fabric, and said closure elements functioning to create a profiled permeability in said fabric by allowing the medial portions thereof to have a first air permeability and forming in said lateral edge portions an air permeability which is lower than the air permeability of said medial portion.

12. The method of claim 11 including weaving said first and second yarns together in said spaced woven lanes extending parallel to the edges of said fabric, forming said open lanes in which only said second yarns extend cross-wise in said fabric, and forming covered lanes in which said closure elements are bound between said second yarns in certain ones of said open lanes to provide covered lanes through which the flow of air is reduced.

13. The method of claim 12 including weaving alternating woven lanes, open lanes, and covered lanes across the width of said fabric as desired to achieve a desired permeability profile of said fabric.

14. The method of claim 11 comprising:

providing first, second, third, and fourth warp yarns in said number of first fabric yarns extending in a warp direction in said fabric;

providing weft yarns in said number of second fabric yarns extending cross-wise to said warp direction;

weaving said first and second warp yarns with weft yarns in a first outer fabric layer;

weaving said third and fourth warp yarns together with said first and second warp yarns with weft yarns in an intermediate fabric layer;

weaving said third and fourth warp yarns together with weft yarns in a second outer fabric layer; and including and binding said closure elements between one of said outer layers and said intermediate layers.

* * * * *